US010502007B2

(12) United States Patent
Gao et al.

(10) Patent No.: US 10,502,007 B2
(45) Date of Patent: Dec. 10, 2019

(54) COMPOSITE CENTRALIZER BLADE

(71) Applicant: Halliburton Energy Services, Inc., Houston, TX (US)

(72) Inventors: Bo Gao, Spring, TX (US); Nicholas Budler, Claremore, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 89 days.

(21) Appl. No.: 15/326,770

(22) PCT Filed: Aug. 18, 2014

(86) PCT No.: PCT/US2014/051490
§ 371 (c)(1),
(2) Date: Jan. 17, 2017

(87) PCT Pub. No.: WO2016/028260
PCT Pub. Date: Feb. 25, 2016

(65) Prior Publication Data

US 2017/0204685 A1 Jul. 20, 2017

(51) Int. Cl.
*E21B 17/10* (2006.01)
*E21B 17/22* (2006.01)

(52) U.S. Cl.
CPC ..... *E21B 17/1078* (2013.01); *E21B 17/1028* (2013.01); *E21B 17/22* (2013.01)

(58) Field of Classification Search
CPC ..... E21B 17/10
See application file for complete search history.

(56) References Cited

U.S. PATENT DOCUMENTS 3,351,136 A * 11/1967 Nelson ..... E21B 17/1035 166/173
5,358,042 A 10/1994 Stoltz
(Continued)

FOREIGN PATENT DOCUMENTS

WO WO-2014082183 A1 * 6/2014 ..... E21B 17/10

OTHER PUBLICATIONS

International Search Report and Written Opinion issued in related PCT Application No. PCT/US2014/051490 dated May 15, 2015, 15 pages.

(Continued)

*Primary Examiner* — Robert E Fuller
*Assistant Examiner* — Theodore N Yao
(74) *Attorney, Agent, or Firm* — John W. Wustenberg; Baker Botts L.L.P.

(57) ABSTRACT

In accordance with embodiments of the present disclosure, a centralizer for aligning a tubular in a wellbore includes a stepped centralizer feature. The stepped centralizer feature includes a composite material with a stepped profile. That is, the stepped centralizer feature includes a first layer of the composite material having a convex rounded side for interfacing with the tubular, and a second layer of the composite material extending from the first layer. The first layer is wider than the second layer. The stepped centralizer feature may be a centralizer blade bonded to an outer surface of the tubular, or a stop collar used to hold a centralizer spring in place on the tubular. The stepped centralizer feature helps to distribute stress through the centralizer feature so that the centralizer feature does not crack or de-bond from the tubular in low temperature, high pressure environments.

20 Claims, 9 Drawing Sheets

(56) References Cited

U.S. PATENT DOCUMENTS

| | | | | |
|---|---|---|---|---|
| 5,937,948 | A * | 8/1999 | Robbins, III | E21B 17/1078 166/241.6 |
| D674,818 | S * | 1/2013 | Andrigo | D15/21 |
| 8,555,961 | B2 | 10/2013 | Koloy et al. | |
| 8,573,296 | B2 | 11/2013 | Levie | |
| 8,678,096 | B2 | 3/2014 | Lively et al. | |
| 2003/0010540 | A1* | 1/2003 | Kirk | E21B 17/1042 175/325.5 |
| 2004/0112592 | A1 | 6/2004 | Gremillion | |
| 2007/0163778 | A1* | 7/2007 | Wheeler | E21B 17/042 166/241.6 |
| 2008/0217063 | A1* | 9/2008 | Moore | E21B 17/1042 175/57 |
| 2011/0036574 | A1 | 2/2011 | MacDonald et al. | |
| 2011/0260457 | A1* | 10/2011 | Hall | E21B 21/103 290/52 |
| 2013/0098601 | A1* | 4/2013 | Pereyra | E21B 17/1042 166/241.4 |
| 2013/0206273 | A1* | 8/2013 | Guest | B82Y 30/00 138/174 |
| 2013/0233568 | A1 | 9/2013 | Levie et al. | |
| 2013/0319689 | A1 | 12/2013 | Levie et al. | |
| 2013/0319690 | A1 | 12/2013 | Levie et al. | |

OTHER PUBLICATIONS

International Preliminary Report on Patentability issued in related Application No. PCT/US2014/051490, dated Mar. 2, 2017 (12 pages).

* cited by examiner

COMPOSITE CENTRALIZER BLADE

CROSS-REFERENCE TO RELATED APPLICATION

The present application is a U.S. National Stage Application of International Application No. PCT/US2014/051490 filed Aug. 18, 2014, which is incorporated herein by reference in its entirety for all purposes.

TECHNICAL FIELD

The present disclosure relates generally to well drilling and hydrocarbon recovery operations and, more particularly, to composite centralizer blades disposed on casing or tubing in hydrocarbon recovery operations.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

Some wellbore servicing methods employ wellbore tubulars that are lowered into the wellbore for various purposes throughout the life of the wellbore. Since wellbores are not generally perfectly vertical, centralizers are used to maintain the wellbore tubulars aligned within the wellbore. Alignment may help prevent any friction between the wellbore tubular and the side of the wellbore wall or casing, potentially reducing any damage that may occur. In addition, alignment of casing within the wellbore via a centralizer may help to provide an appropriate clearance while the casing is cemented in place.

Some centralizers used on casing and tubing include centralizer blades made from composite materials that are bonded directly to the outside of the tubular. Using such composite materials can enhance well design in certain ways. In other systems, bowspring centralizers may be placed on a tubular having stop collars located at either end of the centralizer to maintain the centralizer position relative to the tubular as the tubular is conveyed into and out of the wellbore. In such systems, the stop collars may include composite materials bonded directly to the outside of the tubular. However, in low temperature, high pressure environments, the composite material used to form these centralizer blades and stop collars may crack or de-bond from the tubular at the interface between the tubular and the composite material. Accordingly, it is now recognized that a need exists for improved centralizer blades, stop collars, and other composite components bonded to a tubular in a way that such extreme conditions do not affect the bonding.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
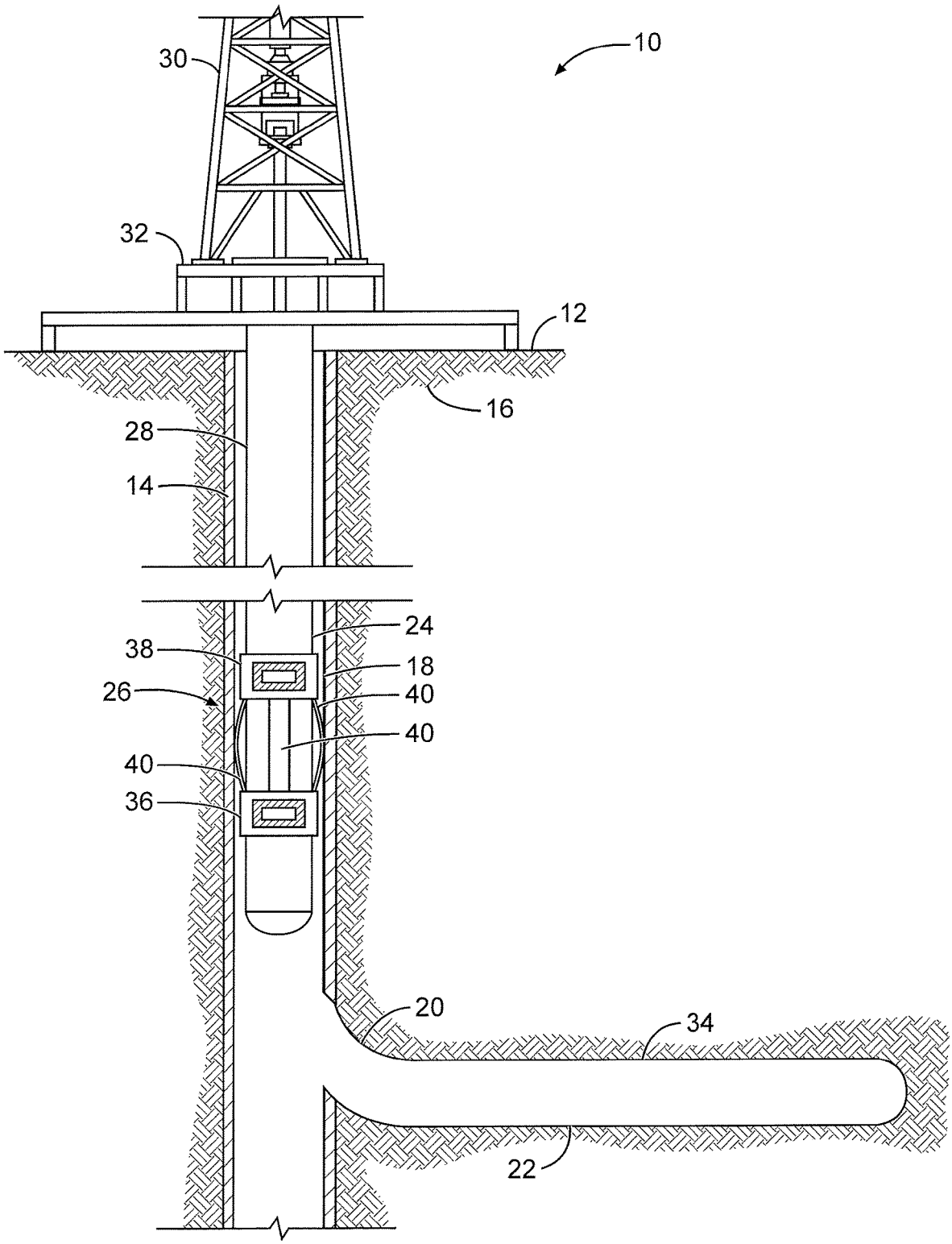
FIG. 1 is a schematic partial cross-sectional view of a wellbore servicing system being deployed in a wellbore drilling environment, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to centralizers and centralizer features made from composite materials, such as fiber reinforced ceramics, that are bonded to an outer surface of a tubular. In some embodiments, the composite materials make up centralizer blades that are used to interface between the tubular and the wellbore or casing, thereby aligning the tubular within the wellbore/casing. In other embodiments, the composite materials make up stop collars that are used to maintain a position of a bowspring centralizer along a length of tubular.

Traditional centralizer blades made from composite materials typically feature either flat or arced blades, and such blades tend to concentrate stress at the edges of the bonding surface between the blades and the tubular. Due to the relatively high attack angle (e.g., closer to 90 degrees than to 0 degrees) between the composite blade and the tubular, the edges of the blades often crack and de-bond from the tubular in low temperature, high pressure environments. Despite attempts to remedy the cracking at the bonding surface by using different composite materials, cracks are still observed in these traditional composite centralizer blades under extreme temperature and pressure conditions.

Present embodiments are directed to centralizer blades and other composite features bonded to the tubular having a stepped profile with relatively thin edges. The term "stepped profile" generally means that the centralizer features have a first layer bonded directly to the tubular and a second layer extending upward from the first layer. The first layer is wider than the second layer, having relatively thin edges that extend outward to interface with the tubular. The stepped profile decreases an attack angle of the centralizer feature relative to the edge of the tubular, since the first layer does not extend to a maximum height of the centralizer feature.

As a result of the decreased attack angle, the centralizer feature does not encounter as high stresses as would be present using traditional centralizer features. In addition, performance of the centralizer features are enhanced since material stresses are no longer highest at the edges of the centralizer features. Instead, the highest stresses occur at the more robust body portion of the centralizer features. Further, in some embodiments the stresses are compressive, pushing the centralizer features into better engagement with the tubular. It should be noted that the improved performance available through the presently disclosed blade profile may benefit centralizers that are used in all conditions (e.g., high temperature and low temperature) of wellbore environments. Still further, the stepped profile enables the use of less material to form the centralizer feature than would be used in traditional systems, thereby lowering the cost of materials, weight of the centralizers, and time spent injection molding the centralizer features.

Referring now to FIG. 1, an example of a wellbore operating environment is shown. As depicted, the operating environment includes a drilling rig 10 that is positioned on the earth's surface 12 and extends over and around a wellbore 14 that penetrates a subterranean formation 16 for the purpose of recovering hydrocarbons. The wellbore 14 may be drilled into the subterranean formation 16 using any suitable drilling technique. The wellbore 14 extends substantially vertically away from the earth's surface 12 over a vertical wellbore portion 18, deviates from vertical relative to the earth's surface 12 over a deviated wellbore portion 20, and transitions to a horizontal wellbore portion 22. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbore for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 24 including a centralizer 26 may be lowered into the subterranean formation 16 for a variety of drilling, completion, workover, or treatment procedures throughout the life of the wellbore 14. The embodiment shown in FIG. 1 illustrates the wellbore tubular 24 in the form of a casing string being lowered into the subterranean formation 16. It should be understood that the wellbore tubular 24 having a centralizer 26 is equally applicable to any type of wellbore tubular being inserted into a wellbore, including as non-limiting examples liners, drill pipe, production tubing, rod strings, and coiled tubing. The centralizer 26 may also be used to centralize various subs and workover tools. In the embodiment shown in FIG. 1, the wellbore tubular 24 including the centralizer 26 is conveyed into the subterranean formation 16 in a conventional manner and may subsequently be secured within the wellbore 14 by filling an annulus 28 between the wellbore tubular 24 and the wellbore 14 with a cement material.

Although only one centralizer 26 is illustrated in FIG. 1, it should be noted that such centralizers 26 may be positioned at various points along a length of a string of wellbore tubular 24. For example, several centralizers 26 may be positioned along the wellbore tubular 24, with approximately 30 feet to 120 feet between adjacent centralizers 26.

The drilling rig 10 includes a derrick 30 with a rig floor 32 through which the wellbore tubular 24 extends downward from the drilling rig 10 into the wellbore 14. The drilling rig 10 uses a motor driven winch and other associated equipment for extending the casing string into the wellbore 14 to position the wellbore tubular 24 at a selected depth. While the operating environment depicted in FIG. 1 refers to a stationary drilling rig 10 for lowering and setting the wellbore tubular 24 and the centralizer 26 within a land-based wellbore 14, in alternative embodiments, mobile workover rigs, wellbore servicing units (such as coiled tubing units), and the like may be used. It should be understood that a wellbore tubular 24 having the centralizer 26 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 34 may include a section of the wellbore 14 ready to be cased with the wellbore tubular 24. In some embodiments, the centralizer 26 may be disposed on production tubing in a cased or uncased well. In some embodiments, a portion of the wellbore 14 may include an underreamed section. As used herein, underreaming refers to the enlargement of an existing wellbore below an existing section, which may be cased in some embodiments. An underreamed section may have a larger diameter than a section upward from the underreamed section. Thus, a wellbore tubular passing down through the wellbore may pass through a smaller diameter passage followed by a larger diameter passage.

Regardless of the type of operational environment in which the centralizer 26 is used, it will be appreciated that the centralizer 26 serves to aid in guiding and placing the wellbore tubular 24 through the wellbore 14. As described in greater detail below, the centralizer 26 may include several pieces of composite material bonded to the outside of the wellbore tubular 24 and offset from one another to span the entire circumference of the wellbore tubular 24. In other embodiments, such as illustrated, the centralizer 26 may include stop collars 36, 38, and a plurality of bow springs 40 connecting the collars 36, 38. The centralizer 26 serves to center the wellbore tubular 24 (e.g., casing string) within the wellbore 14 as the wellbore tubular 24 is conveyed within the wellbore 14. In some embodiments, the collars 36, 38 may be constructed as pieces of composite material that are bonded to the outside of the wellbore tubular 24.

As noted above, the centralizer 26 may include composite material, such as a ceramic composite material, bonded directly to the wellbore tubular 24 or a tubular portion of a centralizer sub. It is now recognized that existing centralizer components made from such composite materials are susceptible to cracking and de-bonding from the wellbore tubular 24 in low temperature and high pressure environments. These conditions are often encountered at the mudline of deep-water wells. Accordingly, present embodiments of the centralizer 26 include centralizer features made from composite materials bonded to the wellbore tubular 24 and having a stepped profile to reduce undesirable stresses on the centralizer features.

Figure 2:
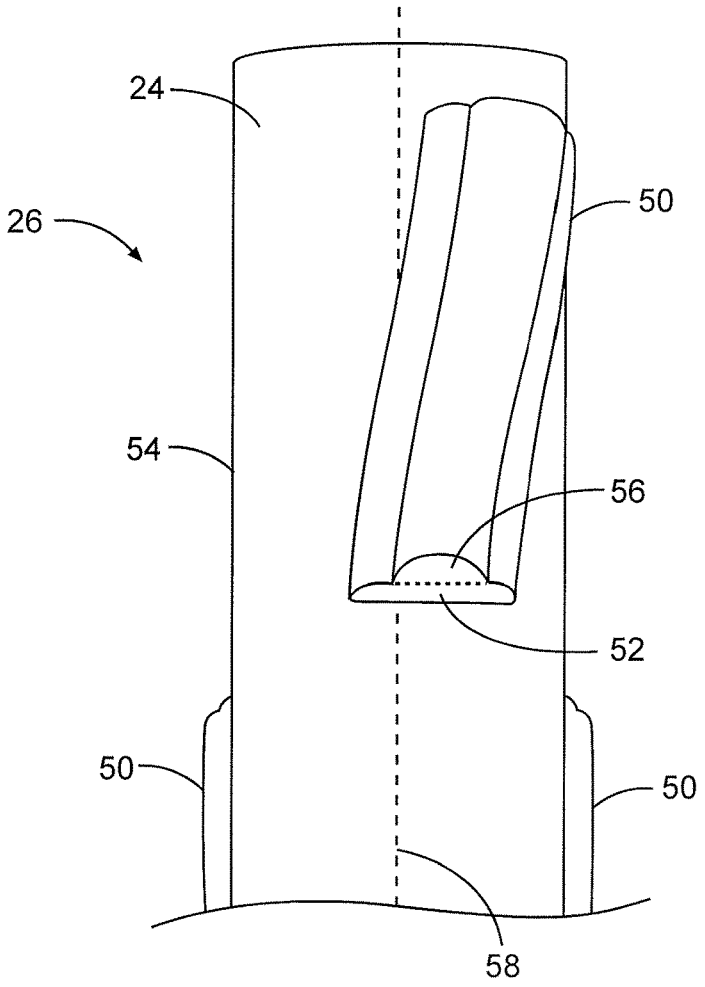
FIG. 2 is a perspective view of a length of tubular with composite centralizer blades having a stepped profile, in accordance with an embodiment of the present disclosure.

FIG. 2 illustrates an embodiment of the centralizer 26 that utilizes centralizer blades 50 made of composite material bonded directly to the wellbore tubular 24. Again, these centralizer blades 50 may be constructed from a ceramic composite material, such as a resin with carbon fibers dispersed therein. In some embodiments, the centralizer blades 50 may be formed from one of several formulations of Protech. In other embodiments, the composite material may include different types and concentrations of fibers added to any desirable epoxy, resin, or other ceramic base that can be bonded to the wellbore tubular 24.

As illustrated in FIG. 2, the centralizer blades 50 each include a stepped profile. The stepped profile refers to the two-part cross-sectional shape of the centralizer blades 50. More specifically, each centralizer blade 50 includes a first layer 52 of composite material extending from an outer surface 54 of the wellbore tubular 24 and a second layer 56 of composite material extending from the first layer 52 in a direction away from the wellbore tubular 24. As illustrated, the first layer 52 is wider than the second layer 56, the first layer 52 having thin edges that extend outward and are bonded to the outer surface 54 of the wellbore tubular 24. Different embodiments of this stepped profile are described in detail below.

The illustrated centralizer 26 includes multiple centralizer blades disposed around and bonded to the wellbore tubular 24. The different centralizer blades 50 may be radially offset from one another relative to an axis 58 of the wellbore tubular 24. In addition, some embodiments may include several centralizer blades 50 longitudinally offset along the axial direction of the wellbore tubular 24. The centralizer 26 is arranged this way so that the centralizer blades 50 can keep all sides and sections of the wellbore tubular 24 from touching an inside wall of the wellbore (or casing disposed in the wellbore).

The stepped profile of the centralizer blade 50, as illustrated, is maintained along the entire length of the centralizer blade 50. In some embodiments, the centralizer blades 50 bonded to the wellbore tubular 24 may be aligned lengthwise with the axis 58 of the wellbore tubular 24. In other embodiments, however, the lengths of the centralizer blades 50 may be straight and slanted relative to the axis 58, in order to provide good centralization around the entire circumference of the wellbore tubular 24. Some embodiments of the centralizer 26 may have centralizer blades 50 with their lengths arranged in a spiral or helically wrapped shape around the wellbore tubular 24. This may ensure that no sections of the wellbore tubular 24 are contacting the wellbore (or casing disposed in the wellbore). In addition, when cementing the wellbore tubular 24 into the wellbore, the spiral arrangement may ensure that the cement does not become stuck on its way down the wellbore.

Figure 3:
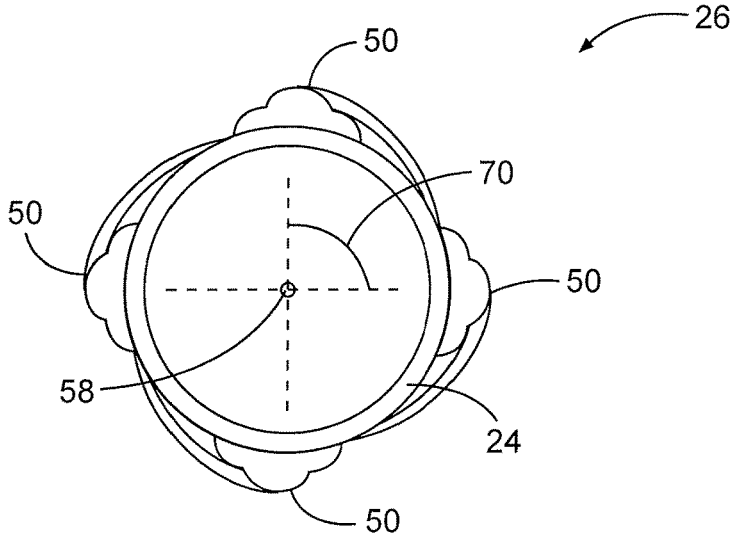
FIG. 3 is an above view of a length of tubular with composite centralizer blades having a stepped profile, in accordance with an embodiment of the present disclosure.

As illustrated in FIG. 3, multiple centralizer blades 50 with a stepped profile may be arranged in a spiral rotating around the axis 58 of the wellbore tubular 24 while moving longitudinally in the direction of the axis 58. In the illustrated embodiment, the centralizer 26 includes four centralizer blades 50 arranged 90 degrees from each other around the circumference of the wellbore tubular 24. The lengths of the centralizer blades 50 may wrap 90 degrees (angle 70) around the wellbore tubular 24. In other embodiments, some of the illustrated centralizer blades 50 may be offset from one another along the axial direction of the wellbore tubular 24.

In some embodiments, the centralizer blades 50 may be pre-formed blades that are attached to the wellbore tubular 24 in any desired configuration. For example, the centralizer blades 50 may be constructed and delivered to a well site, where operators then determine where the centralizer blades 50 should be arranged around the wellbore tubular 24. The operators then bond the centralizer blades 50 in the desired placement and orientation around the wellbore tubular 24 via epoxy.

Figure 4:
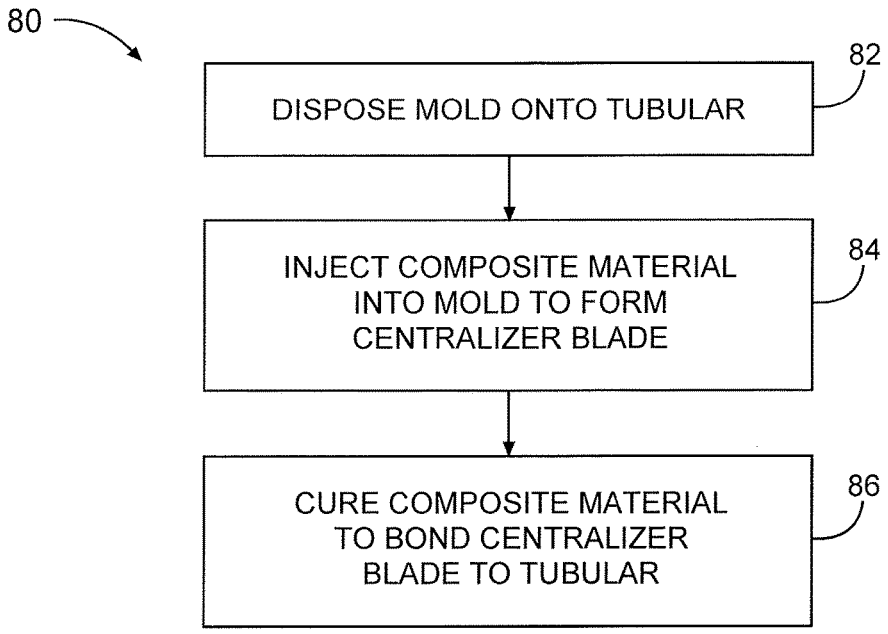
FIG. 4 is a process flow diagram of a method for constructing the composite centralizer blades of FIG. 2, in accordance with an embodiment of the present disclosure.

In other embodiments, the centralizer blades 50 may be formed at the well site. FIG. 4 is a process flow diagram illustrating a method 80 for manufacturing one such centralizer. The method 80 includes disposing (block 82) a mold onto the wellbore tubular after cleaning the outer surface of the wellbore tubular to remove any debris. The mold may have the stepped profile. The method 80 also includes injecting (block 84) a composite resin material into the mold to form a centralizer blade having the stepped profile disclosed herein. The method 80 further includes curing (block 86) the composite resin material to bond the centralizer blade to the wellbore tubular. Thus, the centralizer blades may be formed and bonded to the wellbore tubular at the well site.

Figure 5:
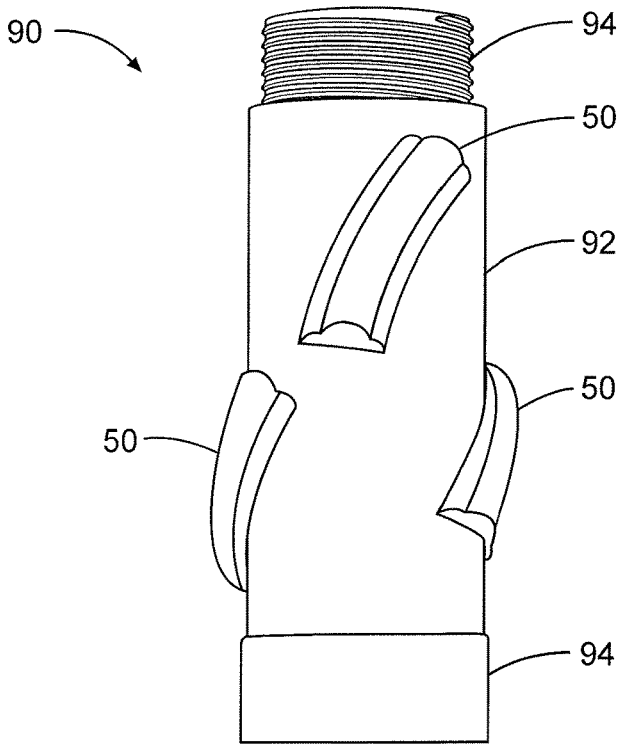
FIG. 5 is a perspective view of a centralizer sub having composite centralizer blades with a stepped profile, in accordance with an embodiment of the present disclosure.

In still further embodiments, the centralizer blades 50 may be delivered to a well site pre-formed onto a centralizer sub 90, as illustrated in FIG. 5. The centralizer sub 90 includes a tubular portion 92 with the centralizer blades 50 formed thereon. The tubular portion 92 also includes connectors 94 (e.g., threaded connectors) designed to mate with complementary connectors of the wellbore tubular that is delivered into the wellbore. One or more of these centralizer subs 90 may be positioned between adjacent lengths of wellbore tubular to form a tubular string to be lowered into the wellbore. The centralizer sub 90 may be pre-formed using either of the methods discussed above. That is, the centralizer blades 50 may be pre-formed and attached via epoxy to the tubular portion 92 of the centralizer sub 90, or the centralizer blades 50 may be molded and cured directly on the tubular portion 92.

Figure 6:
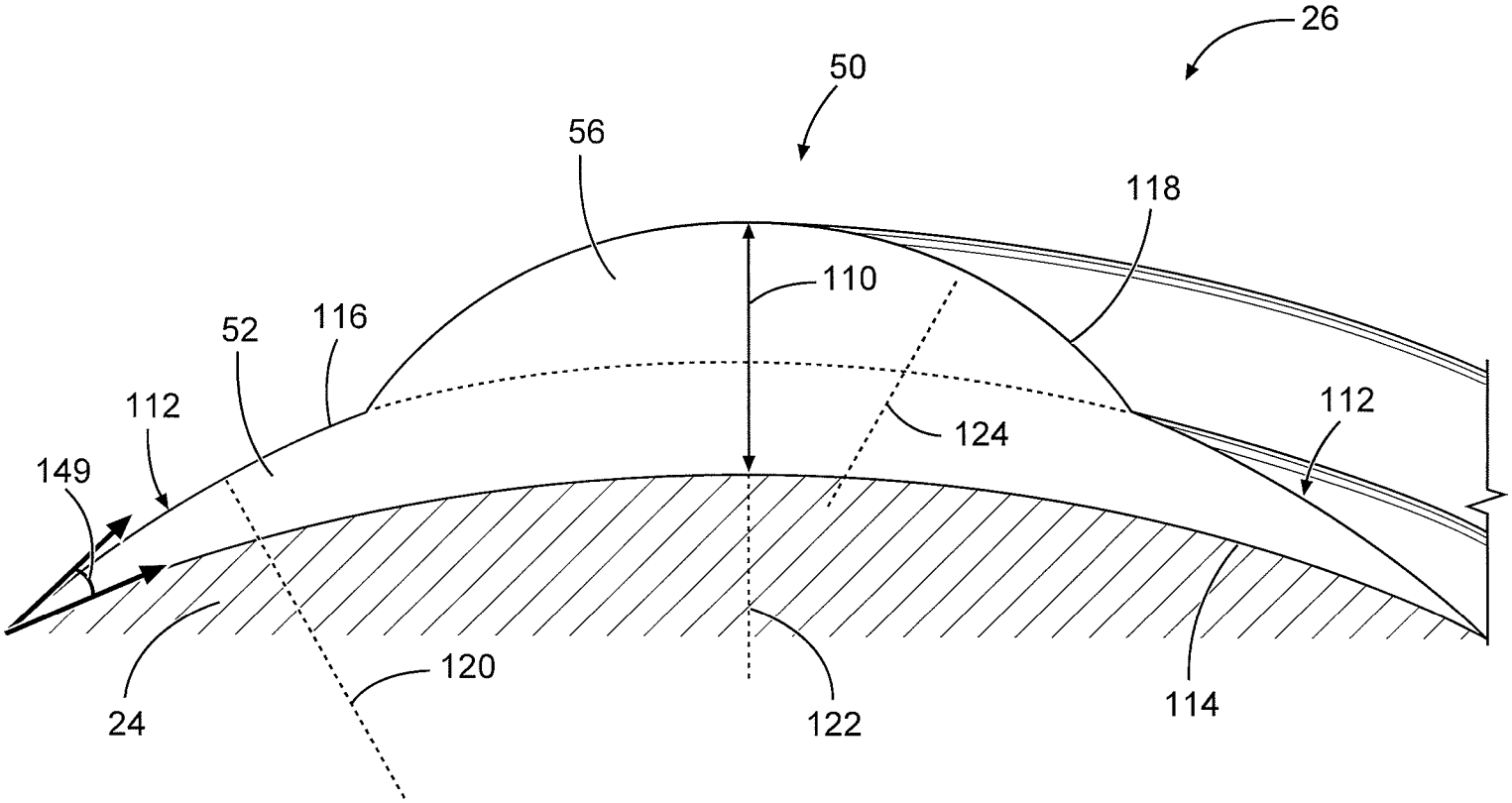
FIG. 6 is a perspective cutaway view of a composite centralizer blade with a rounded stepped profile, in accordance with an embodiment of the present disclosure.

Having now discussed the general context of these stepped centralizer blades 50, a more detailed description of the stepped profile of the centralizer blades 50 will be provided. FIG. 6 is a cross-sectional view of an embodiment of the centralizer blade 50, showing the stepped profile. The stepped design features two layers 52 and 56. The lower layer 52 forms thin edges that extend outward and around the wellbore tubular 24. The upper layer 56 extends away from the wellbore tubular 24 to reach a maximum height 110 of the centralizer blade 50. The maximum height 110 of the centralizer blade 50 may be determined for customers based on the size of the wellbore or casing into which the wellbore tubular 24 and centralizer 26 is being disposed.

Unlike traditional centralizer blade profiles, the disclosed centralizer blades 50 feature thin edges 112 that are made via the first layer 52, then the second layer 56 arises from these edges 112 to reach the maximum height 110 of the centralizer blade 50. The first layer 52 of the centralizer blade 50 includes a convex rounded side 114 that tracks the outer circumference of the wellbore tubular 24. This convex rounded side 114 is the part of the centralizer blade 50 that is bonded to the outer surface of the wellbore tubular 24. To that end, the convex rounded side 114 has a curvature that matches or tracks that of the outer surface of the wellbore tubular 24. Pre-formed centralizer blades 50 may be specially ordered to match a desired curvature of the wellbore tubular 24, or the centralizer blades 50 may be molded directly onto the wellbore tubular 24 so that the convex rounded side 114 automatically matches the tubular curvature.

As illustrated in FIG. 6, the first layer 52 may include rounded edges 116 extending from the convex rounded side 114 while the second layer 56 includes rounded edges 118 extending from the rounded edges 116 of the first layer 52. In this way, the illustrated centralizer blade 50 has a rounded stepped profile. It should be noted that the rounded edges 116 and 118 of the layers 52 and 56, respectively may have a radius of curvature different from each other and different from a radius of curvature of the wellbore tubular 24. For example, the first layer 52 may include the rounded edge 116 having a radius of curvature 120 that is less than a radius of curvature 122 of the wellbore tubular 24. Similarly, the second layer 56 may include the rounded edge 118 having a radius of curvature 124 that is less than the radius of curvature 120 of the first layer 52.

Figure 7:
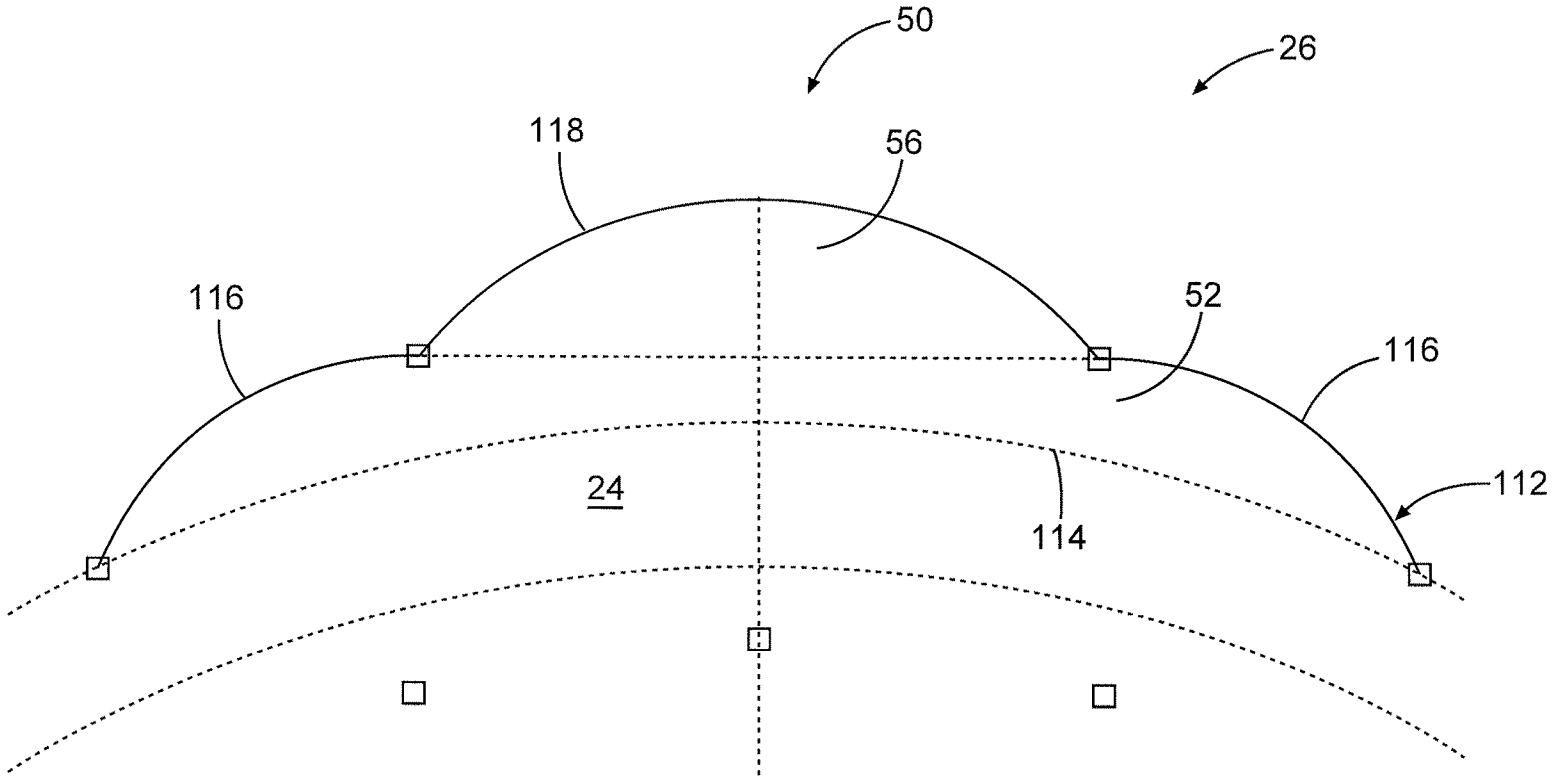
FIG. 7 is a cross sectional view of a composite centralizer blade with a rounded stepped profile, in accordance with an embodiment of the present disclosure.

It should be noted that the thin edges 112 of the first layer 52 do not have to be concentric. As illustrated in FIG. 7, for example, the rounded edges 116 extending from the convex rounded side 114 are not concentric with each other. These rounded edges 116, together with the rounded edge 118 of the second layer 54 extending from the rounded edges 116 still make a stepped profile. In still other embodiments, the stepped profile of the centralizer blade 50 may not be symmetric. For example, one of the thin edges 112 may be formed in a different shape or size than the other thin edge 112 that makes up the first layer 52.

Figure 8:
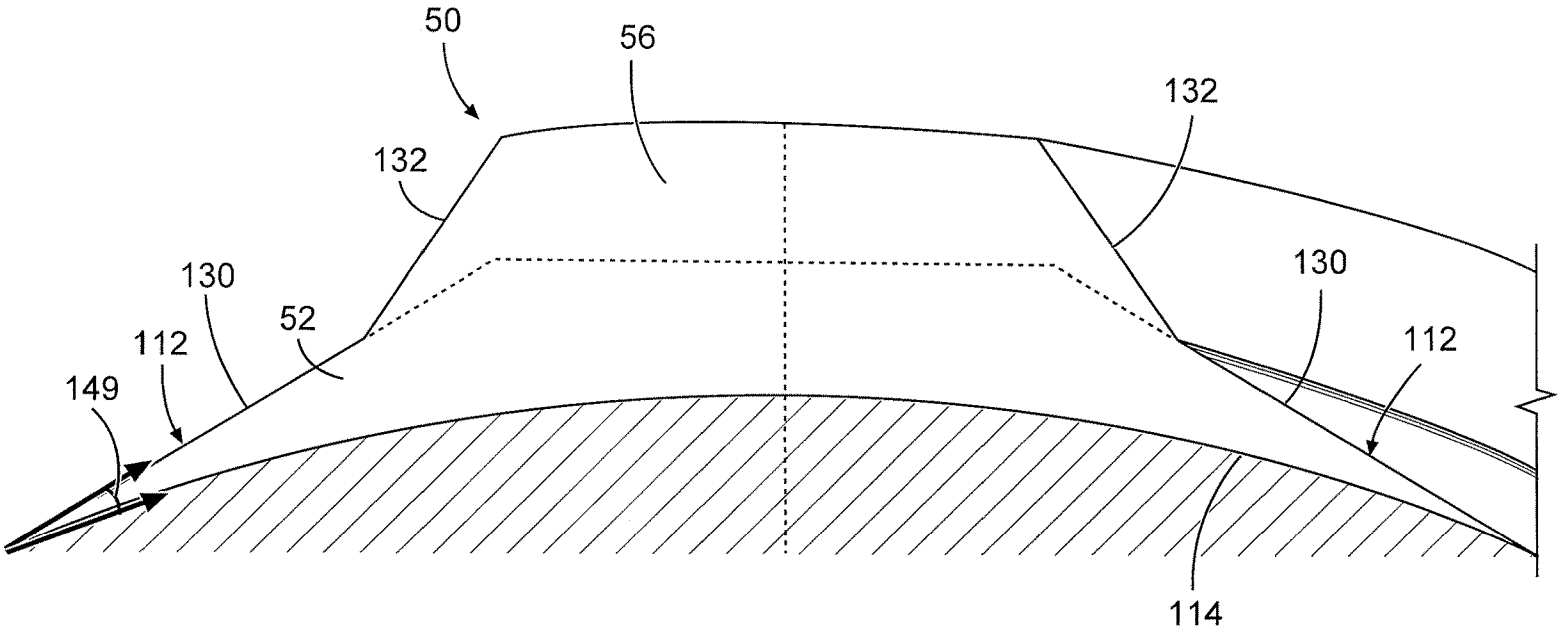
FIG. 8 is a perspective cutaway view of a composite centralizer blade with a prismatic stepped profile, in accordance with an embodiment of the present disclosure.

In other embodiments, as illustrated in FIG. 8, the centralizer blade 50 may have a prismatic stepped profile. In the prismatic stepped centralizer blade, the first layer 52 may include relatively straight edges 130 extending from the convex rounded side 114, while the second layer 56 includes relatively straight edges 132 extending from the straight edges 130 of the first layer 52. It should be noted that prismatic stepped profile may include slightly rounded transitions between adjacent straight edges (e.g., between 130 and 132).

Although the illustrated embodiments of the stepped centralizer blades 50 include just two layers 52 and 56, other embodiments of the stepped centralizer blades 50 may include three, four, five, six, or more layers provided in a stepped configuration. These layers may have either rounded edges or straight edges, and some may have a combination of both rounded edge layers and straight edge layers.

Regardless of whether the centralizer blade 50 features a rounded stepped profile or a prismatic stepped profile, the thin edges 112 of the centralizer blade 50 facilitate a more even distribution of stress through the body of the centralizer blade 50. Instead of the maximum stress occurring where the very edges of the centralizer blade 50 meet the wellbore tubular 24, the maximum stress is decreased and transferred from the bonding surface of the edges to the more robust body of the centralizer blade 50.

Figure 9:
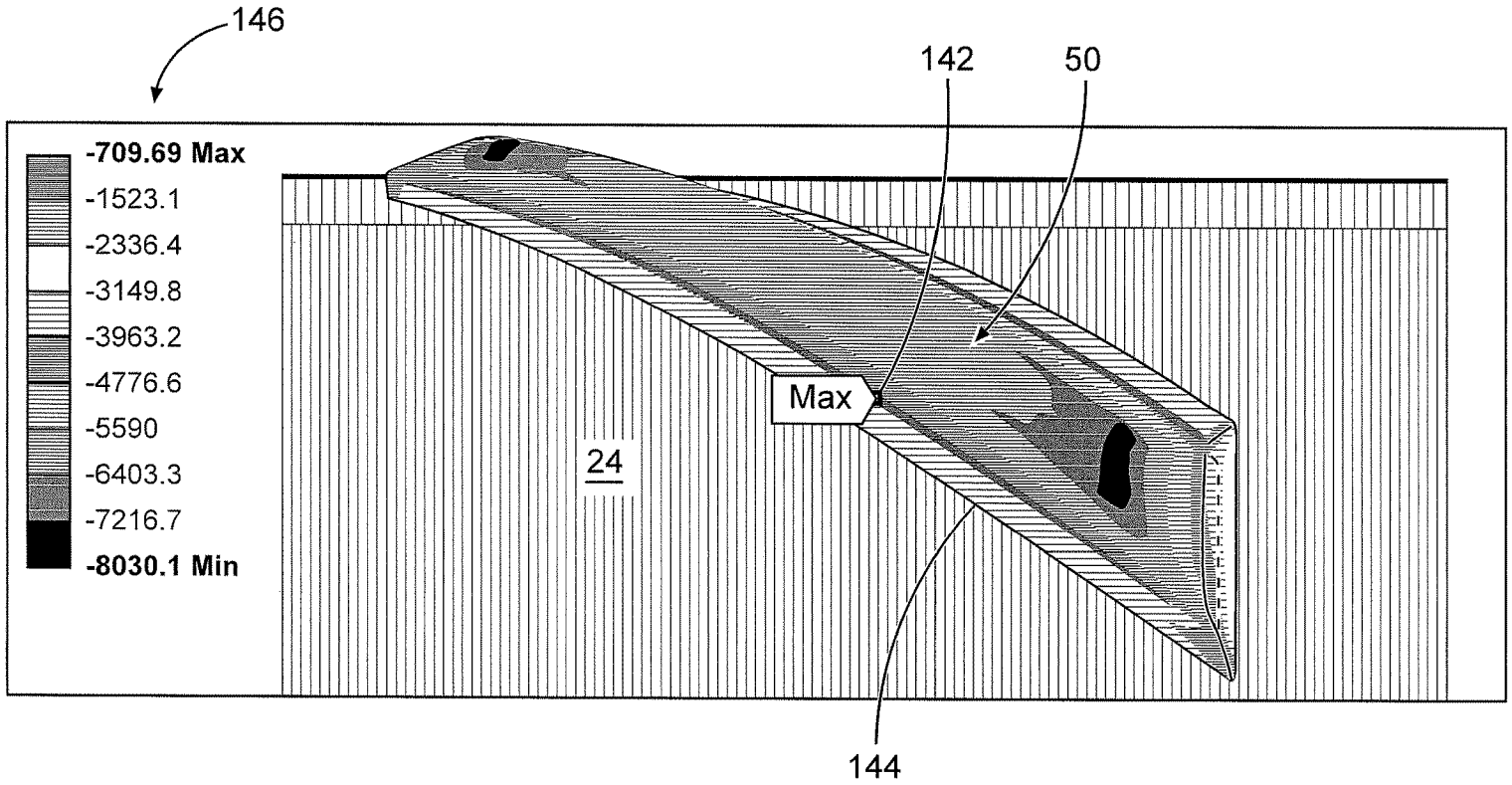
FIG. 9 is a plot illustrating principle stresses on a composite centralizer blade with a stepped profile, in accordance with an embodiment of the present disclosure.

This is illustrated in FIG. 9, which provides a finite element analysis model 140 of the stepped profile centralizer blade 50 under forces expected in a low temperature and high pressure environment. The model 140 shows a point of maximum principle stress 142 within the centralizer blade 50. As noted above, this maximum principle stress 142 is not at the interface between a blade edge 144 and the wellbore tubular 24, where cracking and de-bonding typically occurs in traditional blades. It should be noted that the entire range of principle stresses 146 experienced on the centralizer blade 50 are lower with the stepped profile centralizer blade 50 than with conventional blades. For example, the maximum principle stress in conventional blades under the same conditions is approximately 2900 psi, while the maximum principle stress in the stepped profile blades is approximately −709 psi. Further, the maximum principle stress 142 on the centralizer blade is in a negative direction, indicating that the centralizer blade 50 is in a state of compression. Instead of pulling the centralizer blade 50 from the wellbore tubular 24, the stress is actually pushing the centralizer blade 50 into closer contact with the wellbore tubular 24.

Figure 10:
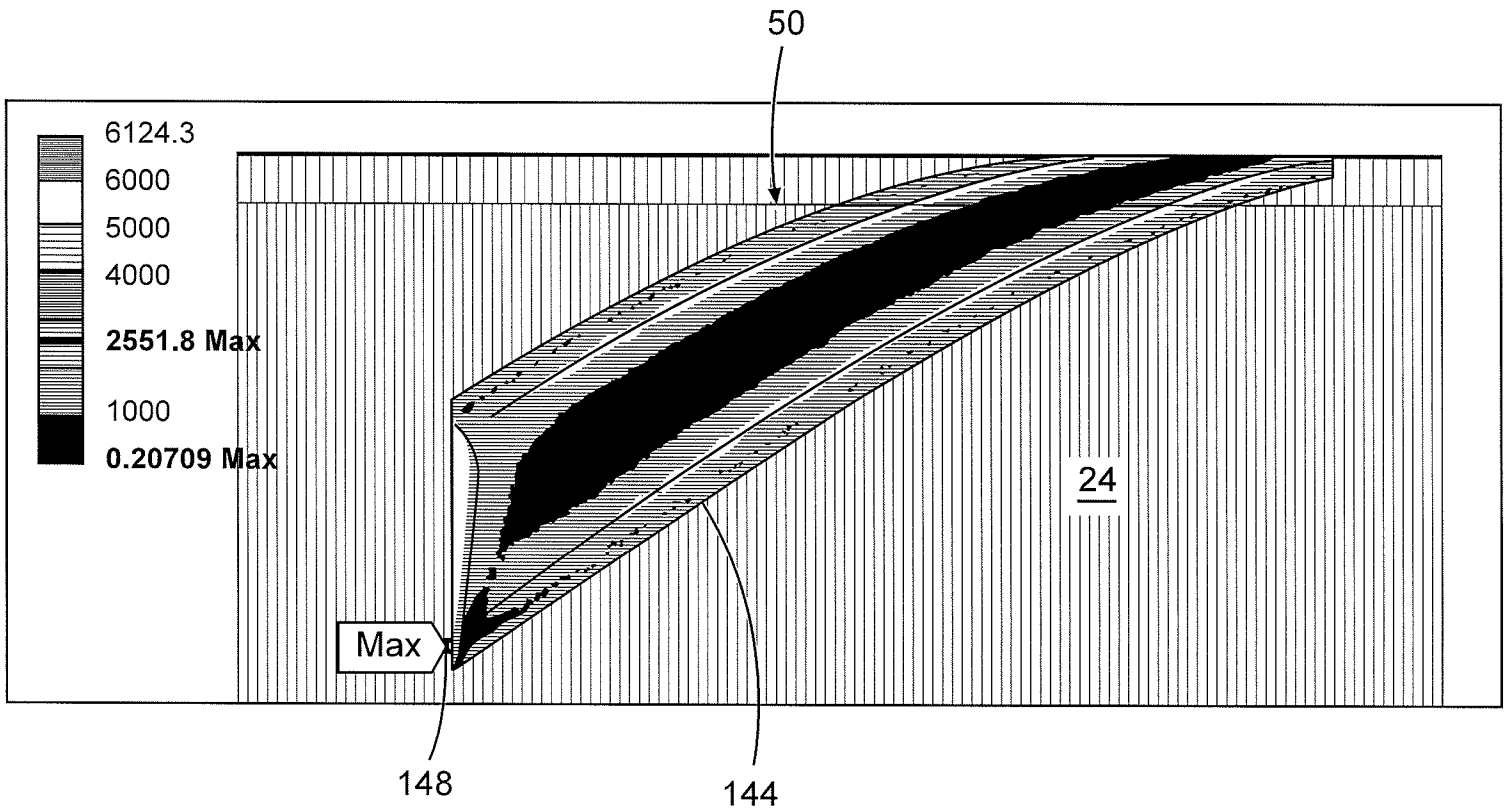
FIG. 10 is a plot illustrating shear stresses on a composite centralizer blade with a stepped profile, in accordance with an embodiment of the present disclosure.

FIG. 10 shows another finite element analysis model 140 of the stepped profile centralizer blade 50, indicating the maximum shear stress 148 expected to occur on the centralizer blade 50. This maximum shear stress 148 is lower with the stepped profile centralizer blade 50 than with conventional blades. For example, the maximum shear stress in conventional blades under the same conditions is approximately 6124 psi, while the maximum shear stress in the stepped profile blades is approximately 2550 psi. In addition, the maximum shear stress 148 is relocated from the interface between the blade edge 144 and the wellbore tubular 24 to an interior body of the centralizer blade 50.

Since cracking and de-bonding failure modes are mechanical mechanisms induced by boundary conditions and differing coefficients of thermal expansion, the stepped profile with thin edges relieves stress that would otherwise be present at the edges of the centralizer blade 50. Specifically, as illustrated in FIGS. 6 and 8, the thin edges 112 of the first layer 52 of the blade 50 extend from the convex rounded side 114 with a relatively low attack angle 149. For example, the attack angle 149 may be less than approximately 90 degrees. In some embodiments, the attack angle 149 may be less than approximately 45 degrees. In still further embodiments, the attack angle 149 may be between approximately 15 and 30 degrees. The attack angle 149 is the angle in which the outermost edge of the first layer 52 extends relative to a tangent of the convex rounded side 114 at the point where the two meet. When the centralizer blade 50 is bonded to the wellbore tubular 24, the attack angle 149 is the angle of the first layer 52 coming off the tangent of the wellbore tubular 24 at the connection point. This lowered attack angle 149 reduces the amount of stress on the centralizer blade 50 at the connection point between the edge 112 of the stepped centralizer blade 50 and the wellbore tubular 24.

Since the stepped profile is a mechanical feature of the centralizer blades 50, it does not depend on a particular chemical formulation of the composite material. Accordingly, the stepped profile does not interfere with previous attempts to improve stress distribution in the centralizer blade 50 via different chemical formulations of the composite material. Therefore, the stepped profile can be used to improve the stress distribution through centralizer blades 50 made from any desirable composite material bonded to the wellbore tubular 24.

As noted above, the stepped profile geometry of the centralizer blades 50 results in a more robust design that allows better blade performance. In addition, the disclosed centralizer blades 50 may be used in a wider range of applicable working conditions for any given composite material formulation. That is, for the same type of material, the centralizer blade 50 having the stepped profile may be used in a wider range of low temperature and high pressure wellbore environments than would be possible with traditionally shaped centralizer blades.

Figure 11:
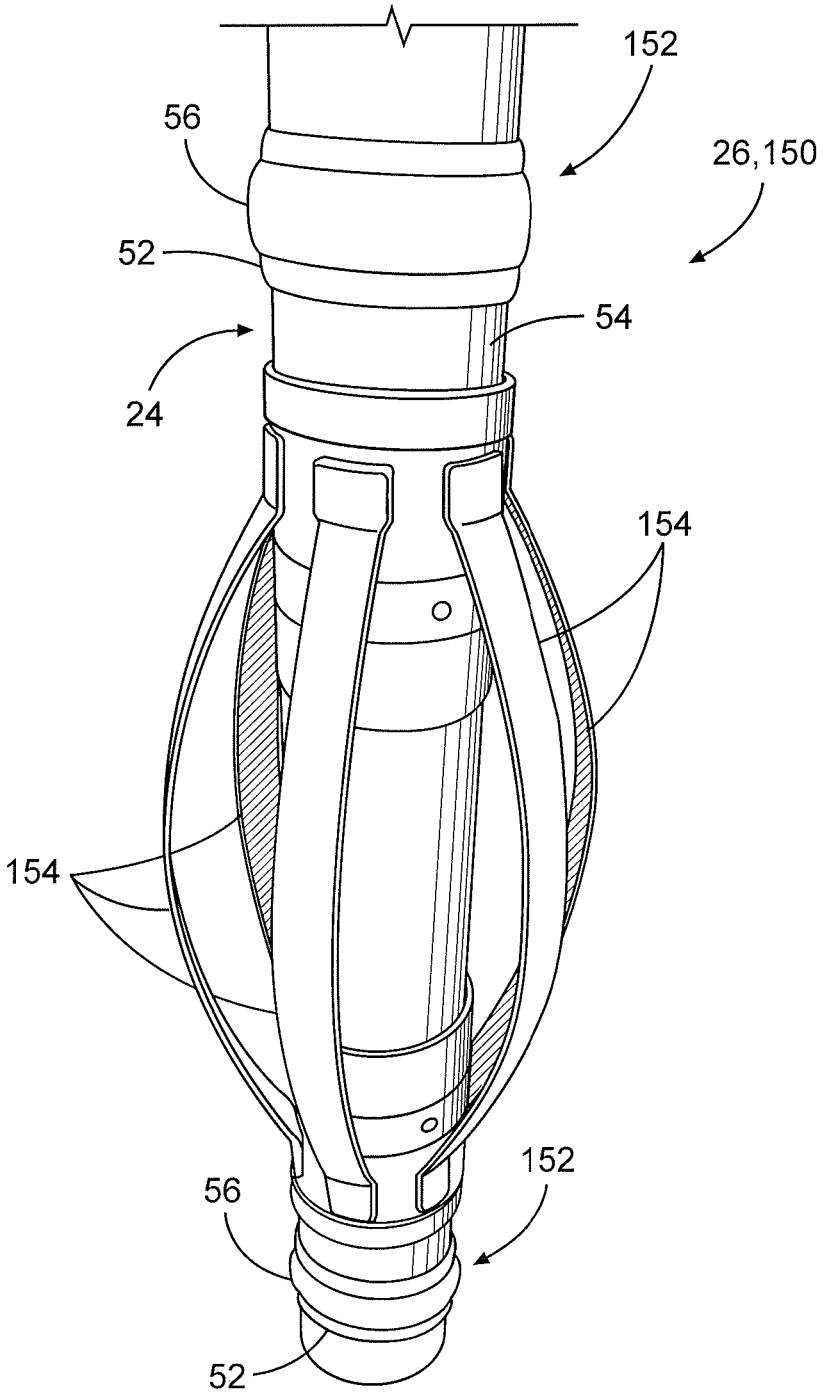
FIG. 11 is a perspective view of a length of tubular with composite centralizer stop collars having a stepped profile, in accordance with an embodiment of the present disclosure.

It should be noted that the stepped profile may be applicable for composite centralizer features other than the centralizer blades 50 discussed above. For example, FIG. 11 illustrates a spring centralizer 150 that utilizes the stepped profile in a different type of centralizer feature made from the composite material. Specifically, the bowspring centralizer 150 includes two stop collars 152 made from a composite material bonded to the outer surface 54 of the wellbore tubular 24. The bowspring centralizer 150 also includes a plurality of bowsprings 154 extending outward from the wellbore tubular 24 to contact an interior wall of the wellbore or casing disposed in the wellbore. The bowsprings 154 are fitted over the wellbore tubular 24 on sliders or collars that can move along the length of the wellbore tubular 24. The stop collars 152 are bonded to the wellbore tubular 24 in order to prevent the bowsprings 154 from shifting along the length of the wellbore tubular 24 as the wellbore tubular 24 is moved through the wellbore.

The stop collars 152 each include the stepped profile geometry discussed in detail above, having the first layer 52 bonded to and extending from the wellbore tubular 24 and the second layer 56 extending from the first layer 52. The illustrated stop collars 152 feature the rounded stepped profile, although other embodiments may include stop collars 152 with the prismatic stepped profile. As discussed in detail above, the use of the stepped profile in composite stop collars 152 bonded to the wellbore tubular 24 may result in better stress distribution in extreme low temperature and high pressure conditions. In addition, the stepped profile decreases the amount of material used and, therefore, the time it takes to form the stop collars 152.

It should be noted that other types of centralizer features and other types of wellbore tools that utilize composite resin materials may be constructed using the disclosed stepped profile. Such features may include, but are not limited to, wear bands, deflection buttons or pads, other centralizer systems, features that utilize advanced and new composite formulations, and weld-A components. In each of these features, where the composite material is bonded to an outer surface of the wellbore tubular 24, the stepped profile may be used to provide better resistance to cracking and debonding when used in low temperature and high pressure environments.

Although the present disclosure and its advantages have been described in detail, it should be understood that various changes, substitutions and alterations can be made herein without departing from the spirit and scope of the disclosure as defined by the following claims.

What is claimed is:

1. A centralizer for aligning a tubular in a wellbore, comprising:

a stepped centralizer feature comprising a composite material shaped in a stepped profile, the stepped centralizer feature having a first layer of the composite material with a concave rounded side for interfacing with the tubular, and a second layer of the composite material extending from the first layer in a direction away from the concave rounded side, wherein the first layer is wider than the second layer, and wherein the composite material comprises a fiber reinforced ceramic, wherein the entire stepped centralizer feature is made from the fiber reinforced ceramic;

wherein the first layer of the composite material extends from the concave rounded side with an attack angle of between 15 and 30 degrees relative to the concave rounded side at two opposite edges of the first layer, wherein the attack angle of between 15 and 30 degrees reduces an amount of stress acting on the stepped centralizer feature at all connection points where the opposite edges of the first layer interface with the tubular to lower than a maximum principal stress on the stepped centralizer feature.

2. The centralizer of claim 1, wherein the concave rounded side of the stepped centralizer comprises a curvature to enable bonding of the stepped centralizer to the tubular.

3. The centralizer of claim 1, wherein the stepped centralizer feature comprises a centralizer blade bonded to the tubular such that the second layer of the stepped centralizer feature extends toward a surface of the wellbore or a casing in the wellbore.

4. The centralizer of claim 3, wherein the centralizer blade maintains a stepped profile having the first layer and the second layer along a length of the centralizer blade.

5. The centralizer of claim 4, wherein the length of the centralizer blade is helically twisted around and bonded to the outer surface of the tubular.

6. The centralizer of claim 4, wherein the length of the centralizer blade is parallel to a longitudinal axis of the tubular.

7. The centralizer of claim 4, wherein the length of the centralizer blade is straight and slanted relative to a longitudinal axis of the tubular.

8. The centralizer of claim 3, further comprising a plurality of stepped centralizer features arranged as centralizer blades for protecting an entire circumference of the tubular from impact with the wellbore or a casing in the wellbore.

9. The centralizer of claim 8, wherein each of the stepped centralizer features of the plurality of stepped centralizer features are disposed at different radial positions along the circumference of the tubular and at different axial positions along a length of the tubular.

10. The centralizer of claim 1, further comprising a bowspring centralizer, wherein the stepped centralizer feature comprises a stop collar bonded to the tubular at an end of the bowspring centralizer to maintain the bowspring centralizer in a position relative to the tubular as the tubular is conveyed through the wellbore.

11. The centralizer of claim 1, wherein the first layer comprises rounded edges extending from the concave rounded side and wherein the second layer comprises rounded edges extending from the rounded edges of the first layer.

12. The centralizer of claim 1, wherein the first layer comprises straight edges extending from the concave rounded side and wherein the second layer comprises straight edges extending from the straight edges of the first layer.

13. The centralizer of claim 1, wherein a total arc length of the concave rounded side extending between the two opposite edges of the first layer is at least twice as large as a maximum distance in which the second layer extends from a point on the concave rounded side, the maximum distance being in a radial direction perpendicular to a tangent of the concave round side at the point.

14. A centralizer sub for aligning a tubular in a wellbore, comprising:

a tubular portion comprising a connector for mating with a complementary connector of the tubular; and a centralizer blade comprising composite material bonded to an outer surface of the tubular portion, wherein the centralizer blade comprises a stepped profile having a first layer of the composite material extending from the outer surface of the tubular portion and a second layer of the composite material extending from the first layer to contact a surface of the wellbore or a casing in the wellbore, wherein the first layer is wider than the second layer, and wherein the composite material comprises a fiber reinforced ceramic, wherein the entire stepped centralizer feature is made from the fiber reinforced ceramic;

wherein the first layer of the composite material extends from the outer surface of the tubular portion with an attack angle of between 15 and 30 degrees relative to the tubular portion at two opposite edges of the first layer, wherein the attack angle of between 15 and 30 degrees reduces an amount of stress acting on the centralizer blade at all connection points where the opposite edges of the first layer interface with the tubular portion to lower than a maximum principal stress on the centralizer blade.

15. The centralizer sub of claim 14, wherein the stepped profile extends along a length of the centralizer blade, and wherein the length of the centralizer blade is helically wrapped around and bonded to the tubular portion.

16. The centralizer sub of claim 14, wherein the stepped profile extends along a length of the centralizer blade, and wherein the length of the centralizer blade is parallel to a longitudinal axis of the centralizer sub.

17. The centralizer sub of claim 14, wherein the stepped profile extends along a length of the centralizer blade, and wherein the length of the centralizer blade is straight and slanted relative to a longitudinal axis of the centralizer sub.

18. The centralizer sub of claim 14, wherein the centralizer blade comprises a rounded stepped profile or a prismatic stepped profile.

19. The centralizer sub of claim 14, wherein the amount of stress acting on the stepped centralizer feature at all connection points where the opposite edges of the first layer interface with the tubular portion is lower than a maximum principal stress on the stepped centralizer feature, and wherein the maximum principal stress is acting on the stepped centralizer feature in a radially inward direction with respect to an axis of the tubular portion.

20. The centralizer sub of claim 14, further comprising an epoxy bonding the centralizer directly to the tubular portion, wherein the centralizer is supported against the tubular portion entirely via the epoxy.

* * * * *